United States Patent [19]

Triner et al.

[11] Patent Number: 4,776,807

[45] Date of Patent: Oct. 11, 1988

[54] COMPLIANT CONTACT

[75] Inventors: Irvin R. Triner, Stickney; Dennis R. Cakora, Manhattan, both of Ill.

[73] Assignee: Methode Electronics, Inc., Chicago, Ill.

[21] Appl. No.: 529,479

[22] Filed: Sep. 6, 1983

[51] Int. Cl.[4] ..... H01R 13/428

[52] U.S. Cl. ..... 439/82; 439/751

[58] Field of Search ..... 339/17 C, 220 R, 221 R, 339/221 M; 439/82, 751, 825–827, 873

[56] References Cited

U.S. PATENT DOCUMENTS

| | | | |
|---|---|---|---|
| 3,493,916 | 2/1970 | Hansen | 339/221 M |
| 3,545,080 | 12/1970 | Evans | 339/252 P |
| 3,824,554 | 7/1974 | Shoholm | 339/252 P |
| 4,017,143 | 4/1977 | Knowles | 339/221 R |
| 4,066,326 | 1/1978 | Lovendusky | 339/17 C |
| 4,166,667 | 9/1979 | Griffin | 339/176 MP |
| 4,183,610 | 1/1980 | Key | 339/17 C |
| 4,265,508 | 5/1981 | Chisholm | 339/221 R |
| 4,359,258 | 11/1982 | Palecek et al. | 339/17 C |

FOREIGN PATENT DOCUMENTS

| | | | |
|---|---|---|---|
| 266177 | 7/1964 | Netherlands | 339/17 C |

*Primary Examiner*—Gil Weidenfeld
*Assistant Examiner*—Gary F. Paumen
*Attorney, Agent, or Firm*—Charles F. Pigott, Jr.; Garrettson Ellis

[57] ABSTRACT

An electrical contact having a compliant section for mounting the contact on a circuit board in a plated-through hole. The compliant section includes a section having a configuration which deforms upon insertion into the circuit board hole and creates positive electrical contact at three points. The contact may include a wire wrap tail and an upper pin or post to mate with a connector.

10 Claims, 3 Drawing Sheets

2
3
4
6
8
10
12

COMPLIANT CONTACT

BACKGROUND OF THE INVENTION

This invention relates in general to electrical contacts and, in particular, to an electrical contact having a compliant section.

More specifically, but without restriction to the particular use which is shown and described, this invention relates to an electrical contact having a compliant section for mounting in the plated-through hole of a circuit board for a variety of electrical applications. The compliant section includes a unique configuration by which three-point contact with a plated-through hole is attained.

In electrical circuits one common type of contact for use in connector assemblies makes electrical contact with a circuit by employing a compliant interface inserted into a plated-through hole of a PC board. Numerous designs for compliant contacts have been used in the past and generally rely on a resilient or deformable structure to engage the hole in the circuit board. In certain applications, however, the contact should have a compliant section that provides adequate pin retention and allows for pin replacement and interchangeability. Besides these objectives, the contact must demonstrate the ability to attain an effective electrical connection when mounted on the circuit board. Prior compliant contacts have generally been able to attain the foregoing objective only with members requiring close tolerances, impractical structural configurations, or designs requiring expensive fabrication techniques.

SUMMARY OF THE INVENTION

An object of this invention is to provide an improved contact having a compliant section.

Another object of this invention is to provide a contact having a compliant section which attains three-point contact when mounted in the plated-through hole of a circuit board.

A further object of this invention is to provide a contact capable of forming a superior electrical connection using a plated through hole with increased tolerances.

Still another object of this invention is to mount a contact having a compliant section on a circuit board in a manner that the center line of the compliant section shifts after mounting to generally coincide with pin and tail.

These and other objects are attained in accordance with the present invention wherein there is provided an improved contact having a compliant section coupling an upper pin and a lower tail of a wire wrappable design and the like. The compliant section includes a pair of spaced sections capable of being compressed into a resilient mounting and attain superior three-point electrical contact with the plated-through hole. Such three-point contact provides positive retention of the pin and better electrical contact without requiring close tolerances as prior art tehniques. The center line of the compliant section of the invention is arranged to shift upon mounting in a manner that the center line coincides generally with the center line of the tail and pin for accurate orientation.

DESCRIPTION OF THE DRAWINGS

Further objects of the invention together with additional features contributing thereto and advantages accruing therefrom will be apparent from the following description of a preferred embodiment of the invention which is shown in the accompanying drawings with like reference numerals indicating corresponding parts throughout wherein.

DESCRIPTION OF THE PREFERRED EMBODIMENT

Figures 1, 2, 3:
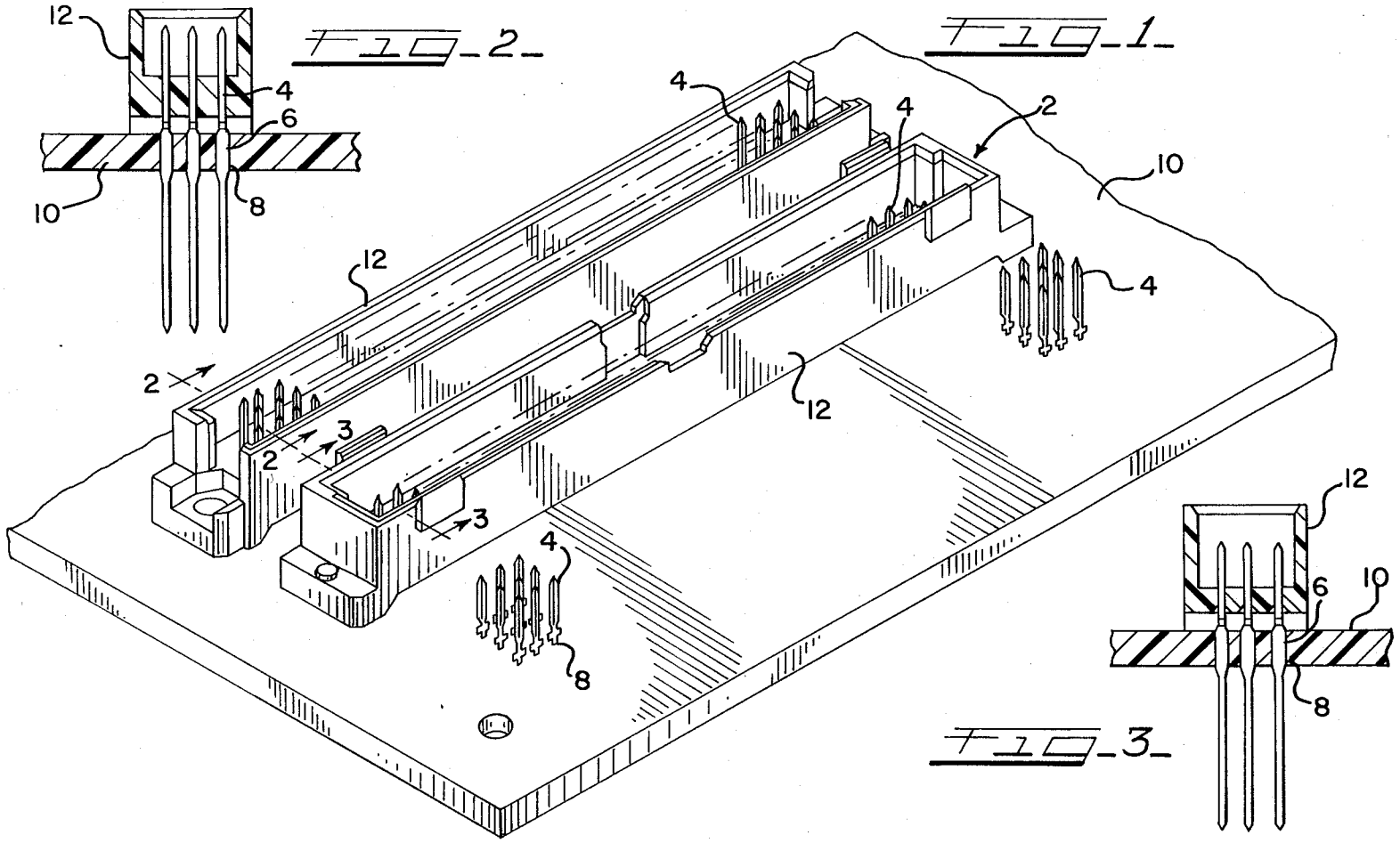
FIG. 1 is a partial perspective view of connector assemblies mounted on a circuit board and employing a plurality of the compliant contacts of the invention in conjunction with an insulator shroud.
FIG. 2 is a partial sectional view, with parts in section, taken along lines 2—2 of FIG. 1.
FIG. 3 is a partial section view, with parts in section, taken along lines 3—3 of FIG. 1.
Figure 6:
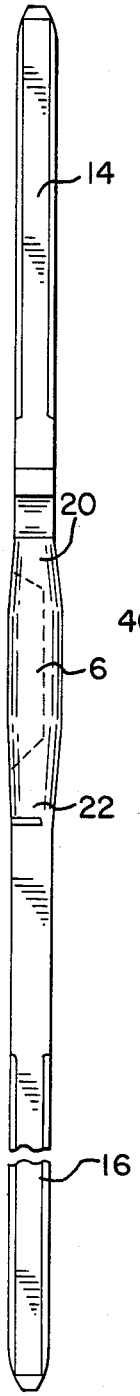
FIG. 6 is a side elevational view of the compliant contact of FIG. 5.

Referring now to FIGS. 1, 2 and 3, there are illustrated connector assemblies 2, employing a plurality of contacts 4 of the invention having a compliant section 6 and mounted on plated-through holes 8 of a circuit board 10. Insulator housings 12 of a standard design may be mounted on the upper pin portions 14 (FIG. 6) of contacts 4 for receiving an electrical component (not shown). In FIGS. 1, 2 and 3, the plurality of contacts 6 are arranged in three rows forming a number of positions compatable with conventional devices. For purposes of illustration, a few contacts 4 are shown without an insulator 12 to provide a view of a protruding upper pin portion of the contacts 4 when mounted on circuit board 10. The contacts 4 may be loaded on the board 10, and the insulators 12 are held by a slight interference fit with the contacts 4.

The lower ends or tails 16 of contacts 6 extend beneath the circuit board 10 and are interconnected with an electrical circuit by a wire wrappable technique or other conventional manner. The circuit board holes 8 are conventional plated-through openings into which compliant section 6 of each contact is resiliently mounted in electrical contact with the board by a suitable retention force.

Figure 4:
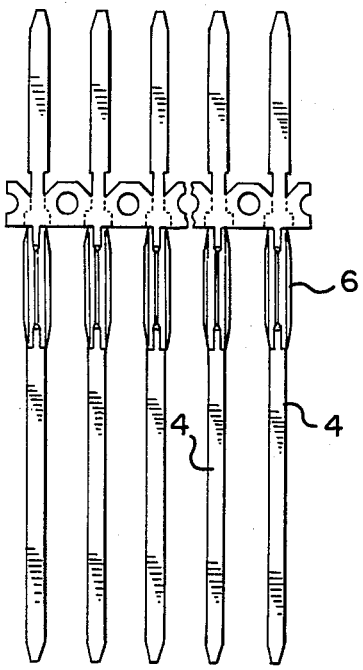
FIG. 4 is a partial elevational view of a plurality of compliant contacts of the invention joined by a carrier for facilitating selective/localized plating.
Figure 5:
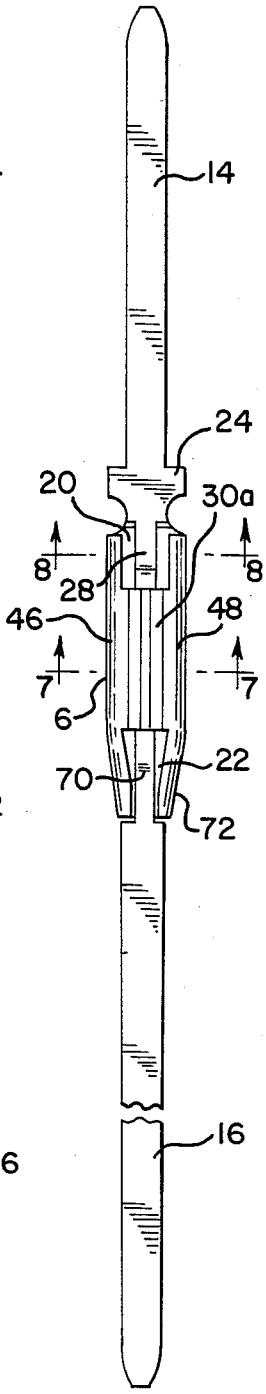
FIG. 5 is a front elevational view of one of the compliant contacts of the invention employed in the connector assemblies of FIG. 1.

Referring now to FIGS. 4–11, details of the contact 4 of the invention are best shown. The contact 4 is formed as a single piece, electrical conductor having an upper pin or post 14 and a lower tail 16. The pin 14 and tail 16 are interconnected by the improved compliant section 6 which forms an interface allowing the contact to be mounted in the plated-through hole 8 with an appropriate square configuration of approximate matching dimensions and respectively merge with the compliant section 6 at transitional zones 20 and 22. The bottom portion of upper pin 12 is formed with flared areas 24 on each side adjacent transitional area 20 as shown in FIG. 5.

Figure 7:
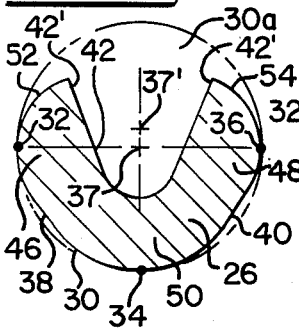
FIG. 7 is a sectional view taken along lines 7—7 of the compliant section of the contact of FIG. 5.
Figure 8:
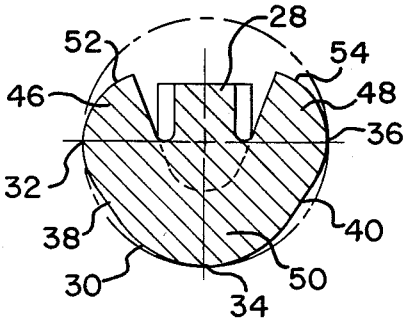
FIG. 8 is a sectional view taken along lines 8—8 of the compliant section of the contact of FIG. 5.

Referring now to FIGS. 5–9, the shape of the transitional zone 20 is mechanically stamped and formed to provide a body 26 wrapping partially about the longitudinal center line of the conact and forming a resiliently yielding structure in compliant section 6. The unique configuration of the compliant section may be created by manufacturing a plurality of symmetrical members in unitized strip form as shown in FIG. 4. As shown in FIGS. 5 and 8, necked down extension 28 of pin 14 is integrally formed on the wrapped around body 26 and extends partially into compliant section 6.

Figure 10:
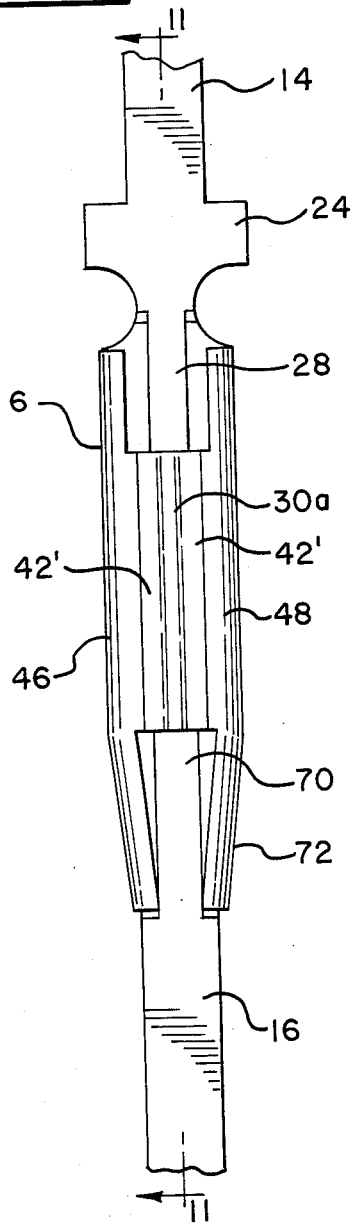
FIG. 10 is an elevational view of the compliant section of the contact of FIG. 5.
Figure 11:
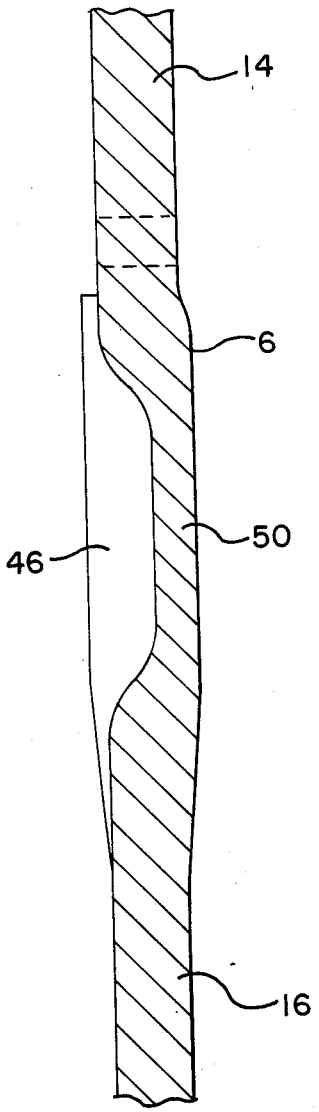
FIG. 11 is a side view, with parts in section, taken along lines 11—11 of FIG. 10.

In FIG. 7, the configuration of the wrapped around body 26 in the intermediate portions of the compliant section 6 beyond the tapered end of the extension 28 is best illustrated. The wrapped around body 26 of the compliant section 6 defines an outer surface 30 having a peripheral cross sectional shape in the form of a "Delta"-like shape with an elongated slot-like configuration 30*a*, as seen in FIGS. 5 and 10. Each of areas 32, 34 and 36 approximately lie at the same outermost radial points of the peripheral surface 30 from the unstressed center line 37 of the compliant section 6. The peripheral flattened areas 38 and 40, disposed respectively between the points 32 and 34, 34 and 36, are designed to lie in spaced relationship to the circuit board in hole 8 when mounted.

The body 26 is cut out at portion 42 to form an extended channel having open slot 30*a* and a modified "V" shaped cross section with a rounded inner apex 44. (FIG. 7) In one embodiment, for example, surfaces 42' defining cut out 42 may be disposed at an angle of approximately 60° of each other. It should be apparent that the foregoing shape of body 26 forms a pair of spaced elongated sections 46 and 48 interconnected by an integral base 50. Each of the outermost areas 32, 34 and 36 of the peripheral surface 30 are respectively disposed in sections 46, 48 and 50. The outer curvature 52, 54 of spaced section 46 and 48 terminate at points radially within the outermost areas 32, 34 and 36 of the compliant section.

Figure 9:
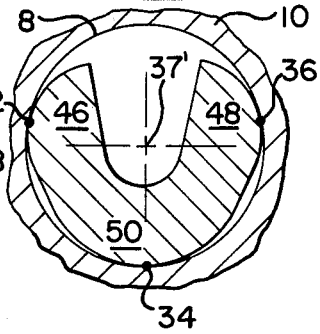
FIG. 9 is similar to the sectional view of FIG. 7 in a compressed configuration mounted in the hole of the board.

The two sections 46 and 48 are designed to flex inward toward each other as shown in FIGS. 8 and 9 upon insertion nnto a plated-through hole 8 having a slightly less diameter than the width of the compliant section. This deflection creates a resilient mounting force in which electrical contact between the plated-through hole 8 and contact 2 occurs at three separate points, namely between the hole 8 and outermost areas 32, 34 and 36 of the compliant section 6. In such an interference fit, the compliant section attains the three-point or "Delta" contact at the discrete points 32*a*, 34*a* and 36*a* substantially along its length.

In FIG. 9, an axis connecting opposed points of contacts 32, 36 lies spaced from the center line 37 after mounting. While in an unstressed condition, the connecting axis passes approximately through the center line. In an unstressed, unmounted configuration, the center line 37 of the compliant section 6, is offset from the common longitudinal center line of post 14 and tail 16. When inserted into hole 8, the deformation of sections 46 and 48 shifts the center line 37 to point 37' (FIG. 8), at which the center line of the compliant section generally is in alignment with the longitudinal center line axis of the pin 14 and tail 16. Such shifting insures proper alignment and symmetry of the contacts 4 when mounted.

The lower transitional area 22 between tail 16 and the compliant section 6 is similar to the transitional area 20 of upper pin 14 with modifications. A necked down extension 70 of the tail 16 extends partially upward into the compliant section 6 and terminates with a tapered end. The wrapped around body 26 of transitional area 24 is generally similar to the configuration shown in FIG. 8, but the width of the body 26 tapers inward on each side 72 of the contact in a downward direction as best shown in FIG. 5. The tapered configuration reduces the force required in inserting the contact into a circuit board hole 8. It should be apparent to one skilled in the art that the tapered shape of zone 22 allows for a more gradual deformation of sections 46' and 48' during hole insertion. The compliant mounting of the pin permits ready interchangeability and replacement.

While the invention has been described with reference to a preferred embodiment, it will be understood by those skilled in the art that various changes may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An electrical contact for mounting on a circuit board comprising:

a conductive body having an upper pin and lower tail; said pin an tail being interconnected by a complaint section formed in said body;

said compliant section arranged to deform upon insertion into the plated-through hole of a circuit board for resilient retention therein; said compliant section having a cross-section of generally U-shape with flattened sides to create three discrete electrical contact areas with the hole when inserted therein, the compliant section defining curved surfaces adjacent the three discrete electrical contact areas which are separated by said flattened sides.

2. The contact according to claim 1 wherein said compliant section includes a cross-sectional configuration having spaced sections disposed on opposite sides of the longitudinal center line of said compliant section and being interconnected by a base section, said spaced sections acting to be deformed toward each other in a mounted relationship on a circuit board.

3. The contact according to claim 2 wherein the peripheries of said spaced sections and said base creates said three electrical contact areas.

4. The contact according to claim 3 wherein said upper pin and lower tail include a longitudinal axis lying in spaced relation to the center line of the compliant section of said body.

5. The contact according to claim 4 wherein said center line of said compliant section shifts generally into alignment with said longitudinal center line of said pin and tail upon said compliant section being mounted on the hole of the circuit board.

6. The contact according to claim 2 wherein said compliant section includes a "Delta"-like shape creating an outer periphery formed by said spaced sections and base section.

7. The contact according to claim 2 wherein each of said contact areas are disposed on outermost sections of the periphery of said contact.

8. The contact according to claim 2 further including strengthening posts respectively extending from said pin and said tail partially into said compliant setion between said spaced sections and said base section thereof.

9. The contact according to claim 1 wherein said pin and said tail have an approximately square cross-sectional configuration.

10. In a circuit board having at least one plated-through hole, an electrical contact positioned in said hole, said contact defining a conductive body having an upper pin and lower tail, said pin and tail being interconnected by a compliant section formed in said body, said compliant section being positioned in said plated-through hole, said compliant section having a cross-section of U-shape with generally flattened sides whereby three discrete electrical contact areas with the hole are provided, with the compliant section being spaced from the wall of said hole along said generally flattened sides between the three discrete electrical contact areas, the outer wall of said compliant section being curved in the vicinity of said electrical contact areas.

* * * * *